US008944212B2

(12) United States Patent
Vaidyaselvan

(10) Patent No.: US 8,944,212 B2
(45) Date of Patent: Feb. 3, 2015

(54) MULTI-SIDED LADDER ASSEMBLY AND METHODS OF UTILIZING SAME

(76) Inventor: Ramalingam Vaidyaselvan, Marlboro, NJ (US)

( * ) Notice: Subject to any disclaimer, the term of this patent is extended or adjusted under 35 U.S.C. 154(b) by 123 days.

(21) Appl. No.: 13/205,515

(22) Filed: Aug. 8, 2011

(65) Prior Publication Data

US 2013/0037349 A1 Feb. 14, 2013

(51) Int. Cl.

| | |
|---|---|
| ***E06C 1/18*** | (2006.01) |
| ***E06C 1/38*** | (2006.01) |
| ***E06C 7/46*** | (2006.01) |
| ***E04G 1/30*** | (2006.01) |
| ***E06C 1/393*** | (2006.01) |
| ***E06C 7/42*** | (2006.01) |

(52) U.S. Cl.

CPC . *E06C 1/18* (2013.01); *E06C 1/382* (2013.01); *E06C 7/46* (2013.01); *E04G 1/30* (2013.01); *E06C 1/393* (2013.01); *E06C 7/42* (2013.01)

USPC ..... 182/118; 182/115; 182/116; 182/117

(58) Field of Classification Search

CPC ..... E06C 7/14; E06C 7/16; E06C 7/42; E06C 7/46; E06C 1/14; E06C 1/16; E06C 1/18; E06C 1/24; E06C 1/26; E06C 1/28; E06C 1/38; E06C 1/382; E06C 1/39

USPC ..... 182/115, 116, 117–119

See application file for complete search history.

(56) References Cited

U.S. PATENT DOCUMENTS

| | | | | | |
|---|---|---|---|---|---|
| 213,686 | A * | 3/1879 | Phillips | 256/1 |
| 296,419 | A * | 4/1884 | Magnus | 182/104 |
| 461,366 | A * | 10/1891 | Odom | 182/102 |
| 561,263 | A * | 6/1896 | Lucas | 182/119 |
| 1,408,604 | A * | 3/1922 | Kawa | 108/177 |
| 1,466,757 | A * | 9/1923 | Riemer | 182/116 |
| 2,304,587 | A * | 12/1942 | Morando | 182/118 |
| 2,394,221 | A * | 2/1946 | Waltz | 182/152 |
| 2,661,082 | A * | 12/1953 | Ziegler | 52/108 |
| 2,718,346 | A * | 9/1955 | Galen | 182/104 |
| 3,250,344 | A * | 5/1966 | Romano | 182/27 |
| 3,842,936 | A * | 10/1974 | De Luca | 182/129 |
| 4,004,652 | A * | 1/1977 | Laboy-Alvarado | 182/118 |
| 4,428,456 | A * | 1/1984 | Rohde | 182/20 |
| 4,690,248 | A * | 9/1987 | Killeen | 182/118 |
| 4,998,599 | A * | 3/1991 | Wang | 182/160 |
| 5,010,978 | A * | 4/1991 | Jimmerson | 182/153 |
| 5,152,368 | A * | 10/1992 | Heiden | 182/118 |
| 5,685,391 | A * | 11/1997 | Gundlach | 182/104 |
| 5,853,281 | A * | 12/1998 | Farmer | 414/537 |
| 6,092,626 | A * | 7/2000 | Young | 182/118 |
| 6,892,860 | B2 * | 5/2005 | Gibson et al. | 182/222 |
| 6,902,036 | B1 * | 6/2005 | Holley | 182/180.2 |
| 6,945,360 | B2 * | 9/2005 | Sullivan, Jr. | 182/151 |
| 2004/0188176 | A1 * | 9/2004 | Wyse | 182/118 |
| 2006/0169535 | A1 * | 8/2006 | Phillips et al. | 182/119 |
| 2010/0071994 | A1 * | 3/2010 | Tseng | 182/27 |
| 2010/0071996 | A1 * | 3/2010 | Huang | 182/118 |
| 2010/0282540 | A1 * | 11/2010 | Moss et al. | 182/119 |

* cited by examiner

*Primary Examiner* — Katherine Mitchell
*Assistant Examiner* — Colleen M Chavchavadze
(74) *Attorney, Agent, or Firm* — Jon Fallon, Esq.; Michael P. Kochka, Esq.

(57) ABSTRACT

Embodiments of the present invention are generally related to a multi-sided ladder assembly and methods of utilizing the same. More specifically, embodiments of the present invention relate to a multi-sided ladder assembly with substantially improved stability, providing for a wide range of applications. In one embodiment of the present invention, a multi-faced ladder assembly comprises: a plurality of individual ladders, a top platform positioned over a top of each of the plurality of ladders, and a plurality of support platforms, each support platform positioned at a bottom end of each of the individual ladders.

11 Claims, 6 Drawing Sheets

MULTI-SIDED LADDER ASSEMBLY AND METHODS OF UTILIZING SAME

BACKGROUND

1. Field of the Invention

Embodiments of the present invention are generally related to a multi-sided ladder assembly and methods of utilizing the same. More specifically, embodiments of the present invention relate to a multi-sided ladder assembly with substantially improved stability, providing for a wide range of applications.

2. Description of the Related Art

Ladders come in various sizes and configurations for both indoor and outdoor use. Common ladders in the marketplace include collapsible A-frame structures, or extension ladders that generally require leaning against a fixed structure, such as an exterior wall of a building.

Contractors, carpenters, painters, and other workmen who often require the use of such ladders are well aware of the hazards created when a ladder must be leaned against a wall or other similar surface for stability. Often, the angle at which a ladder is placed against a surface is determined by the available space or by the workman's need to climb near the top of the ladder rather than any considerations of stability or safety. However, as the workman climbs up the ladder, the risk of slipping or tipping the ladder increases. When using paint brushes, tools or other devices, a workman is likely to shift his or her weight, which may likely increase the risk of slipping or tipping.

Regardless of the configuration or height, the stability of a ladder is one of the most important considerations in ladder design and selection. As such, it is generally recommended that in addition to the worker on the ladder, an additional worker be located at the base of the ladder in order to stabilize the ladder. Unfortunately, many workers operate independently and oftentimes scale and work atop ladders without having another worker support the ladder from below.

In other situations, multiple workers need to work together on multiple ladders, for example, when installing a heavy chandelier. However, because of the size of each ladder's footprint, it is often difficult to put the multiple ladders sufficient close together for each worker to remain balanced on their ladder and assist with the cooperative project. As such, one or more of such workers may have to lean off his or her ladder, risking injury and/or tipping the ladder.

As such, there is a need in the industry for a multi-sided ladder assembly with substantially improved stability, providing for a wide range of applications.

SUMMARY

Embodiments of the present invention are generally related to a multi-sided ladder assembly and methods of utilizing the same. More specifically, embodiments of the present invention relate to a multi-sided ladder assembly with substantially improved stability, providing for a wide range of applications.

In one embodiment of the present invention, a multi-faced ladder assembly comprises: a plurality of individual ladders, a top platform positioned over a top of each of the plurality of ladders, and a plurality of support platforms, each support platform positioned at a bottom end of each of the individual ladders.

In another embodiment of the present invention, a multi-faced ladder assembly comprises: four individual ladders, each ladder comprising a plurality of horizontal steps positioned between a pair of vertical posts, and each ladder being between about six feet to about fifty feet in height; a top platform positioned over a top of each of the ladders, and connected to the top of each of the ladders via a locking means; and a plurality of support platforms, each support platform positioned at a bottom end of each of the individual ladders.

In yet another embodiment of the present invention, a ladder system comprises: a first and second ladder assembly, each of the first and second ladder assemblies comprising a plurality of individual ladders; a top platform positioned over a top of each of the plurality of ladders; and a plurality of support platforms, each support platform positioned at a bottom end of each of the individual ladders; and an expandable platform positioned between the first ladder assembly and the second ladder assembly.

BRIEF DESCRIPTION OF THE DRAWINGS

So the manner in which the above-recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
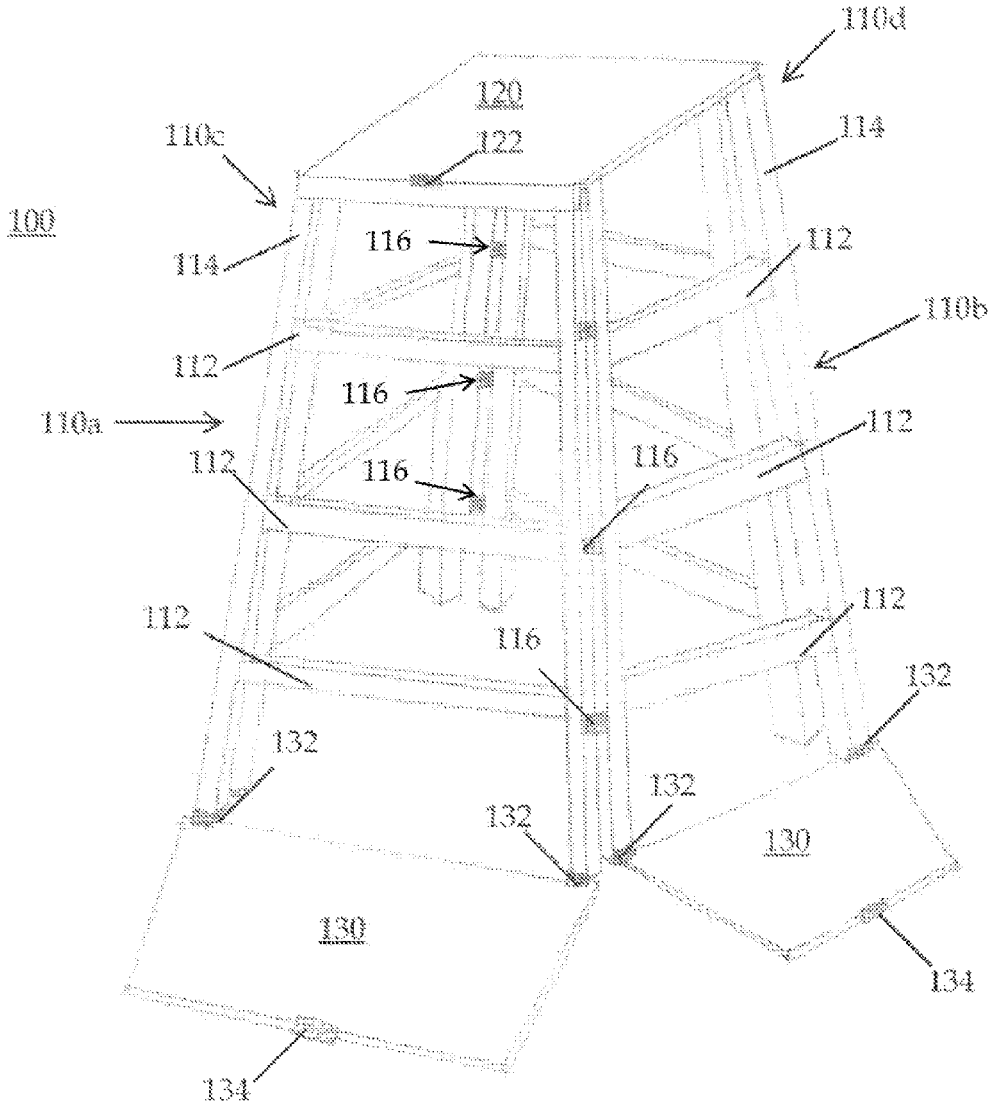
FIG. 1 depicts a perspective view of a multi-faced ladder assembly in accordance with embodiments of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention are generally related to a multi-sided ladder assembly and methods of utilizing the same. More specifically, embodiments of the present invention relate to a multi-sided ladder assembly with substantially improved stability, providing for a wide range of applications.

FIG. 1 depicts a perspective view of a multi-faced ladder assembly in accordance with embodiments of the present invention. In many embodiments, the ladder assembly 100 comprises a plurality of individual ladders 110*a*-110*d*, an optional top platform 120, and a plurality of support platforms 130, each positioned at a bottom end of each of the individual ladders 110*a*-110*d*. Although the Figure shows four individual ladders 110*a*-110*d*, embodiments of the present invention contemplate any plurality (i.e., two or more) of individual ladders along with the other elements disclosed herein.

Each of the individual ladders 110*a*-110*d* (collectively or generally referenced hereinafter as "ladders 110") of the ladder assembly 100 comprise a plurality of steps 112 positioned between a pair of vertical posts 114. In many embodiments, when taken individually, the ladders 110 may strongly resemble common ladders designed to rest against a surface of a structure. The ladders 110 may generally be made from any material suitable for embodiments of the present invention. In many embodiments, the ladders 110 comprise a metal (such as aluminum, steel, iron, or the like), a metal alloy (e.g., aluminum alloy, stainless steel, or the like), a polymer, wood, or similar material having suitable strength to support the weight of individuals and articles, as intended by embodiments of the present invention.

The ladders 110 may also comprise any height suitable for embodiments of the present invention. Because of the basic structure of many embodiments of the present invention, the ladders 110 may be as short as a typical A-frame ladder (e.g., six feet), or as tall as some outdoor ladders (e.g., twenty-five feet, fifty feet, etc.) In some embodiments, each of the ladders 110 may be extendible, similar to a common extension ladder. As such, embodiments of the present invention should not be deemed limited in height or size.

To support the structure of the ladder assembly 100, many embodiments of the present invention provide a plurality of optional ladder securing means 116 for securely, and often releasably, connecting each adjacent ladder 110 to one another. The ladder securing means may comprise any mechanical device or fastener (e.g., hinges, clasps, clamps, screws, rivets, clips, cables, hook and loop fasteners, snaps, straps, etc.) suitable to keep two adjacent ladders 110 properly positioned until an individual intends to disassemble the ladder assembly 100.

Many embodiments of the present invention provide an optional top platform 120. The top platform 120 comprises a substantially flat surface for capping and connecting each of the plurality of ladders 110. The top platform 120 is generally shaped to fit the size and quantity of the ladders 110. For example, in the embodiment shown in the Figure, where four ladders 110*a-d* are provided, the top platform 120 is substantially square having sides substantially equal to the width of the top of each ladder 110. In another exemplary embodiment, where one more or fewer ladders are provided, the top surface 120 may comprise a substantially hexagonal or triangular shape, respectively.

The top platform 120 may generally comprise any material suitable for embodiments of the present invention. In many embodiments, the top platform 120 is manufactured from any of the same materials as the ladders 110. In some embodiments, which are intended to support an individual's weight on the top surface thereof, the top platform 120 may be sufficiently thick and/or rigid to support such intended weight. In other embodiments, the top platform may be designed to support the weight of multiple individuals and equipment thereon.

The top platform 120 may connect to each of the ladders 110 via a locking means 122. Similar to the ladder securing means 116, the locking means 122 may comprise any mechanical device or fastener (e.g., hinges, clasps, clamps, screws, rivets, clips, cables, hook and loop fasteners, snaps, straps, etc.) capable of securely, and often releasably, connecting the top platform to each of the ladders 110. Although only one locking means 122 is shown connecting to the first ladder 110*a*, embodiments of the present invention contemplate any number of locking means 122 affixed between the top platform 120 and each ladder 110, as needed.

The support platform 130 generally comprises a substantially planar structure, rotatably affixed at a bottom end of each of the ladders 110 for providing the ladder assembly 100 significant support to prevent tipping or falling. Generally, the support platform 130 is connected via a hinge 132 to the bottom of each vertical post 114 of each ladder 110. However, in certain embodiments, where the support platform 130 is intended to be removable, the hinge 132 may take the form of any of the mechanical devices or fasteners describe hereinabove with regard to the ladder securing means 116 and the locking means 122. Similarly, in many embodiments, the support platform 130 has a latching means 134 which, similar to the ladder securing means 116 or the locking means 122, may comprise any mechanical device or fastener (e.g., hinges, clasps, clamps, screws, rivets, clips, cables, hook and loop fasteners, snaps, straps, etc.) capable of securely and releasably connecting a free-end of the support platform 130 to a portion of the ladder 110 (e.g., against one of the steps 112 or the vertical posts 114). A more detailed description of the support platform 130 is below with reference to FIGS. 2A and 2B.

Figure 2B:
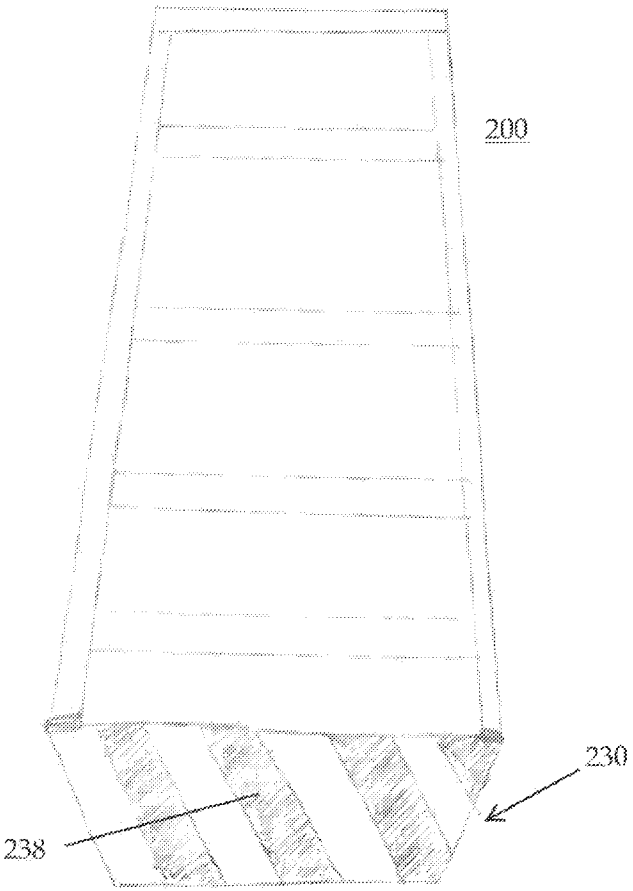
FIGS. 2A and 2B depicts a front view of a multi-faced ladder assembly showing a support platform in a closed position and open position, respectively, in accordance with embodiments of the present invention.
Figure 2A:
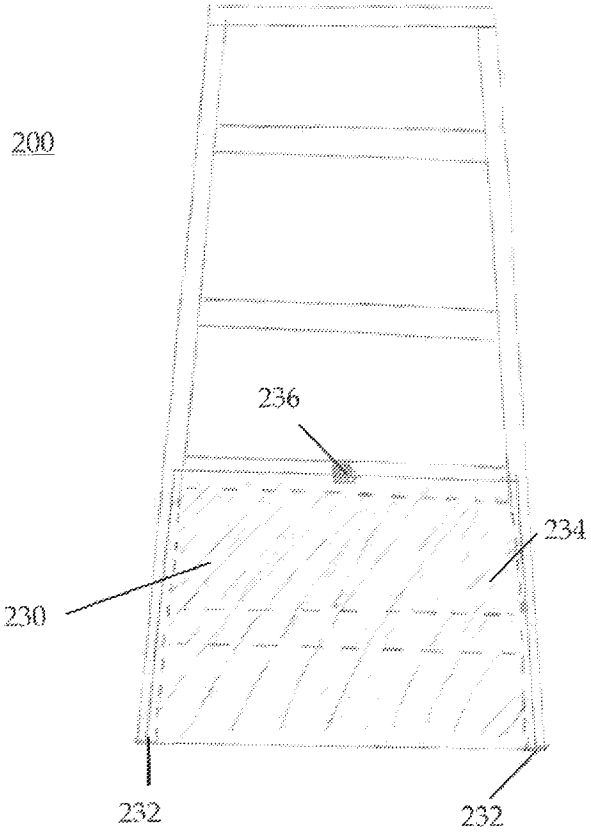

FIGS. 2A and 2B depicts a front view of a multi-faced ladder assembly showing a support platform in a closed position and open position, respectively, in accordance with embodiments of the present invention. As shown in the Figures, a ladder 200 generally comprises a support platform 230 rotatably connected to the ladder via at least one hinge 232. In FIG. 2A, the support platform 230 is shown in a closed position, having its latching means 236 securely and releasably holding the support platform 230 against the ladder by latching with one of the steps.

The bottom surface 234 of the support platform 230 may optionally be coated with any type of material, for example, a non-skid material (e.g., a rubber, polymer or similarly known non-stick material) to assist in ensuring the ladder assembly does not move when the support platform 230 is in an open position, as shown in FIG. 2B. In an open position, the top surface 238 may optionally be provided with a pattern or design for putting persons on notice of the ladders' position. In another embodiment, the top surface 238 may be provided with a non-stick surface, such that any materials that may spill thereon (e.g., paint, adhesive/glue, etc.), could easily be wiped off. In yet another embodiment, the top surface 238 may be provided with a pocket, recessed portion and/or groove(s) to hold certain equipment while an individual climbs the ladder assembly.

Figure 3:
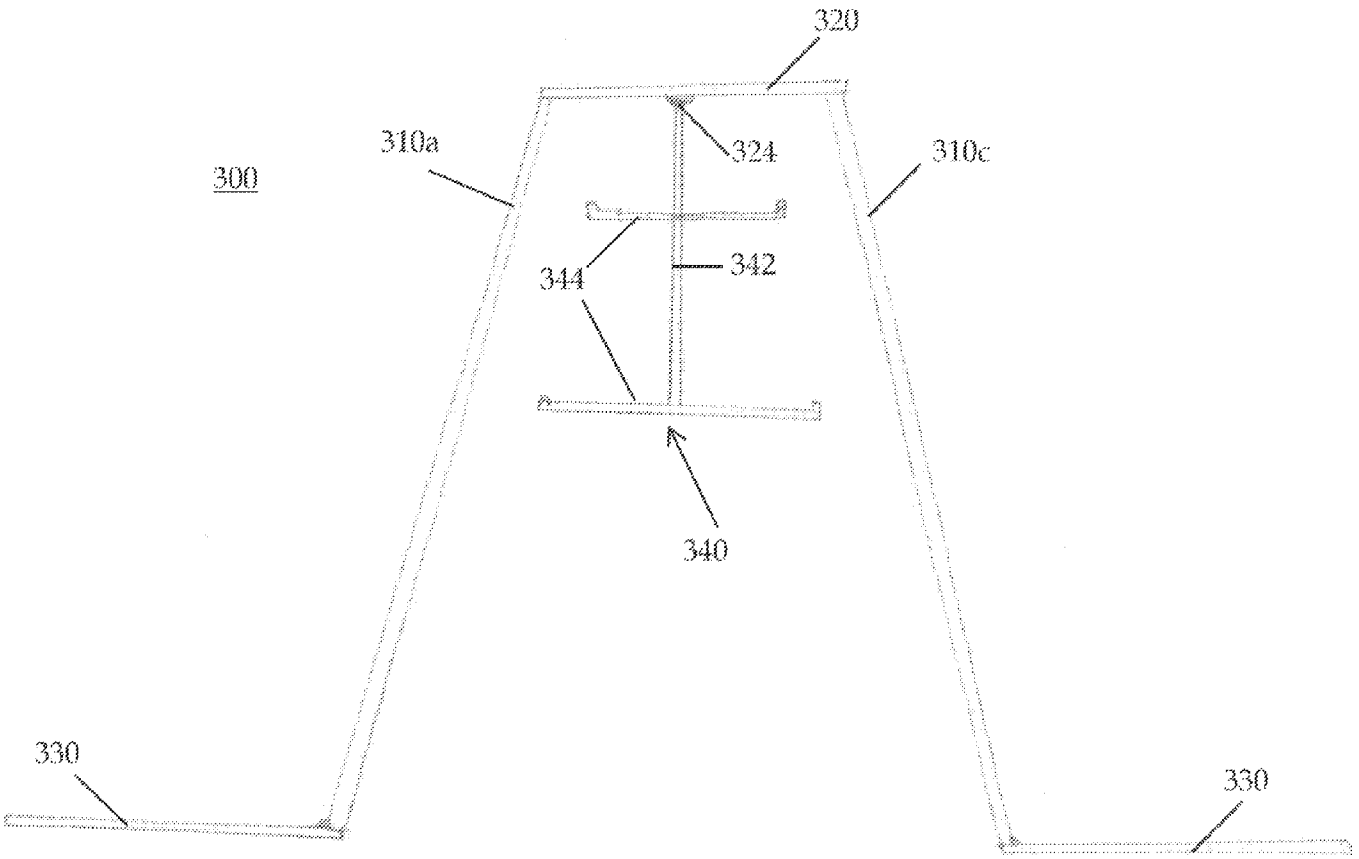
FIG. 3 depicts a cross-sectional view of a multi-faced ladder assembly having a central utility storage unit thereon, in accordance with embodiments of the present invention.

FIG. 3 depicts a cross-sectional view of a multi-faced ladder assembly having a central utility storage unit thereon, in accordance with embodiments of the present invention. A ladder assembly 300 generally comprises a plurality of ladders 310*a* and 310*c*, a plurality of support platforms 330, and a top platform 320. In the embodiment shown in the Figure, a ladder assembly 300 may also comprise a central utility storage unit 340 thereon. In many embodiments, a bottom surface of the top platform 320 comprises an attachment means 324. The attachment means 324 may comprise any structure capable of receiving and holding a central utility storage unit 340. In some embodiments, the attachment means 324 comprises a loop, a threaded slot, a clip, or the like.

The central utility storage unit 340 may comprise any structure capable of storing articles that may be useful while one or more users have climbed the ladder assembly. In the embodiment shown, the central utility storage unit 340 may comprise a central stem 342 having one or more shelves 344 protruding therefrom. In many embodiments, such shelves 344 may be positioned equally about the stem 342, such that a circular, square or rectangular shaped shelf could provide equal access regardless of which ladder 310 of the ladder assembly 300 is climbed. Other types of central utility storage units may comprise buckets, power assemblies (e.g., various batteries and/or outlets for power tools), a tool storage kit (e.g., for different types of nails, screws, bolts, nuts, etc.), or the like.

Figure 4:
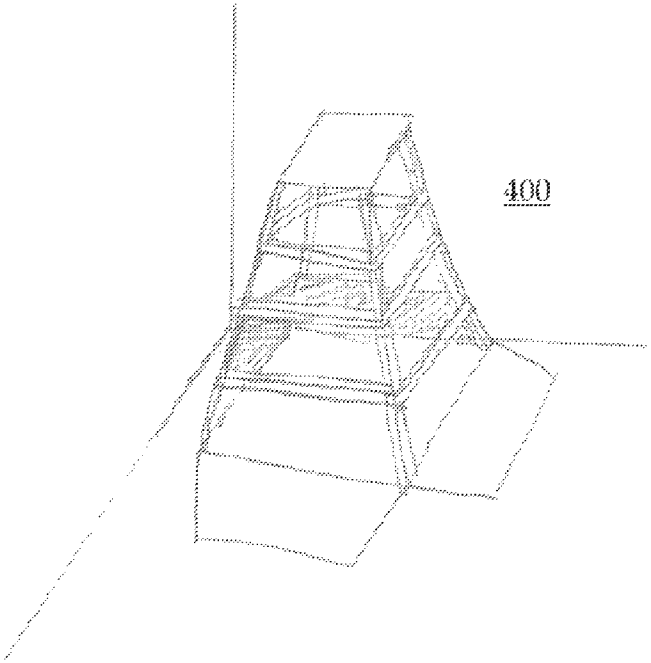
FIG. 4 depicts a prospective view of a multi-faced ladder assembly positioned in the corner of a room, in accordance with embodiments of the present invention.

Embodiments of the present invention may be utilized, whether in the corner of a room or in the center of a room. FIG. 4 depicts a prospective view of a multi-faced ladder assembly positioned in the corner of a room, in accordance with embodiments of the present invention. As shown in the Figure, a ladder assembly 400 may be positioned in the corner of a typical room by closing the two support platforms adjacent to the two walls at the corner, and leaving the other two down.

Figure 5:
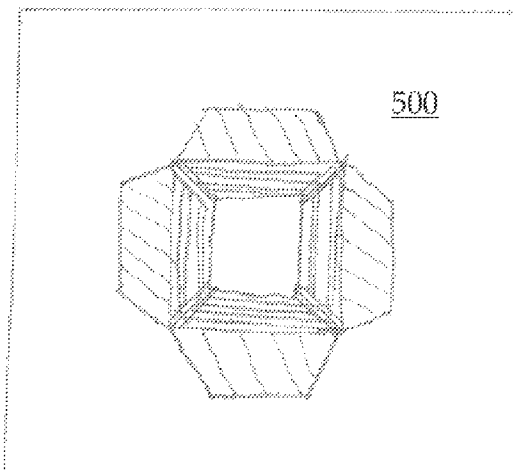
FIG. 5 depicts a top view of a multi-faced ladder assembly positioned in the center of a room, in accordance with embodiments of the present invention.

However, FIG. 5 depicts a top view of a multi-faced ladder assembly positioned in the center of a room, in accordance with embodiments of the present invention. As shown in the Figure, in the center of a room where space is more abundant, the most support for one or more users on the ladder assembly can be achieved when all support platforms are in an open position.

Figure 6:
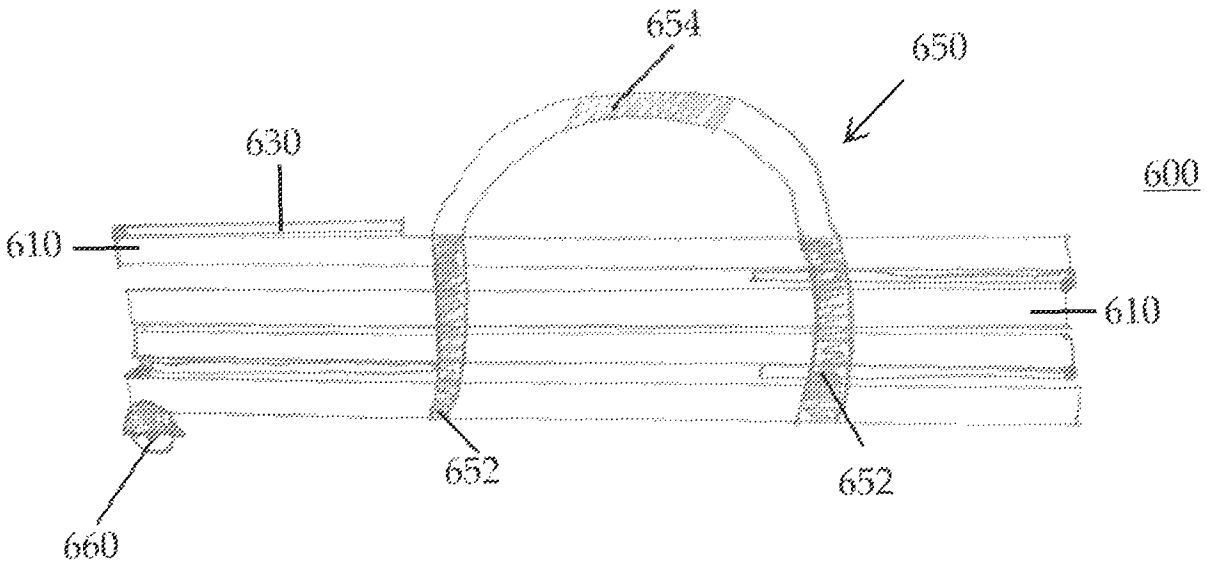
FIG. 6 depicts a side view of a multi-faced ladder assembly in a storage position, in accordance with embodiments of the present invention.

Many embodiments of the present invention may provide for an easy means of storage and/or transport. FIG. 6 depicts a side view of a multi-faced ladder assembly in a storage position, in accordance with embodiments of the present invention. In the embodiment shown, the ladder assembly 600 may be disassembled and packed up for transport. Generally, the ladder securing means may be disconnected between each of the ladders 610 and each of the support platforms 630 are folded to a closed position. The ladders 610 are subsequently stacked on one another. In some embodiments, a storage handle 650, comprising a plurality of bands 652 for going around the stack of ladders 610, and a handle portion 654, is provided. In one embodiment, the plurality of bands 652 comprise removable straps having hook and loop fasteners, snaps, etc. thereon. In another embodiment, the plurality of bands 652 are made of an elastic material and may stretch around the stack of ladders 610 to hold them in place. Once the storage handle 650 is in place, the ladder assembly 600 may be carried away. It should be appreciated, however, the storage handle 650 may also be positioned around the ladders 610 in a perpendicular manner to that shown in the Figure.

Optionally, the ladder assembly 600 may be provided with one or more wheels 660. In such an embodiment, the opposing end of the ladder assembly 600 may comprise a handle, such that a user could roll the ladder assembly 600 during transport. In another embodiment, a plurality of wheels 660 are provided, and the ladder assembly may be wheeled to any particular location. Embodiments of the present invention appreciate the wheels 660 may be easily removable (e.g., via a wingnut or clamp-type assembly), such that the wheels 660 do not interfere with the ladder assembly 600 when in use.

Figure 7:
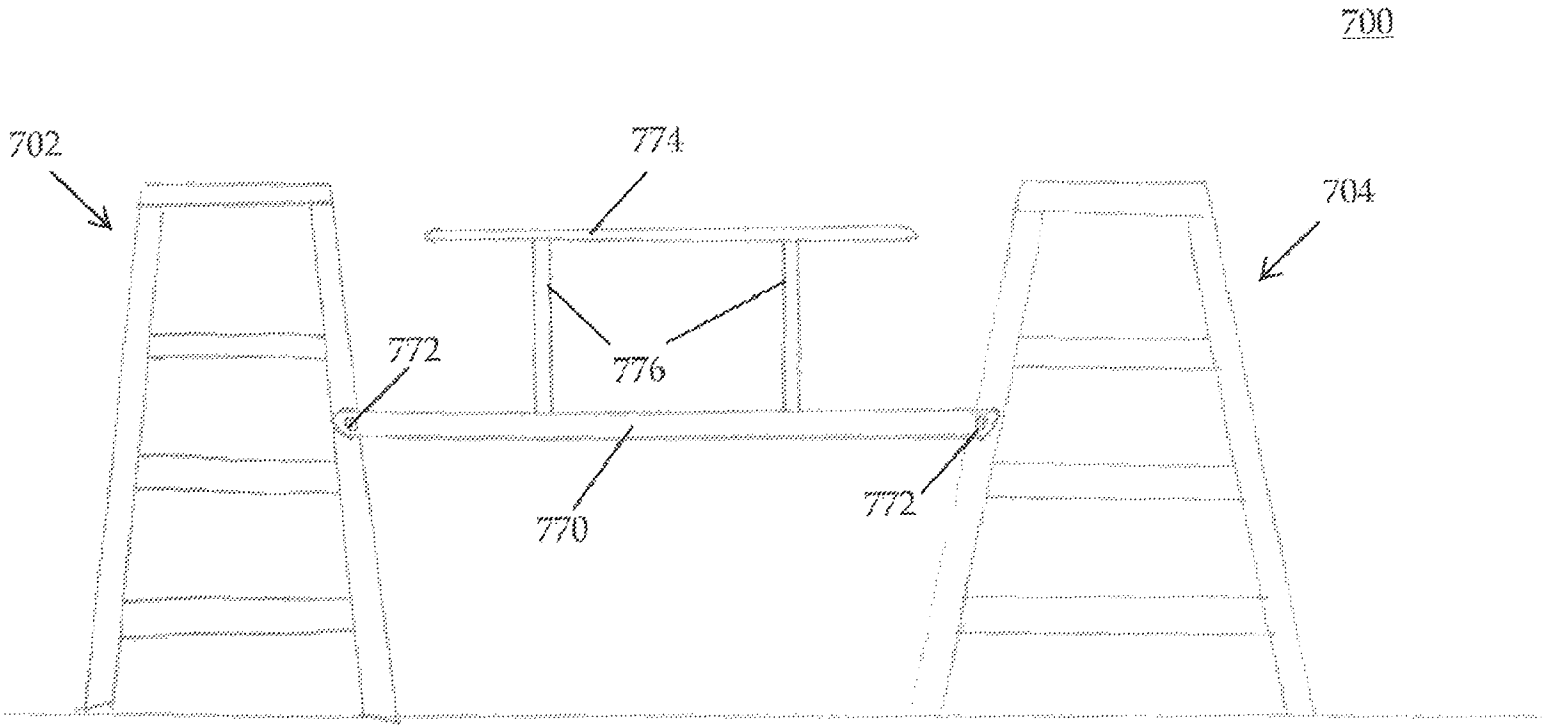
FIG. 7 depicts a cross-sectional view of a set of multi-faced ladder assemblies having an expandable platform therebetween, in accordance with embodiments of the present invention.

FIG. 7 depicts a cross-sectional view of a set of multi-faced ladder assemblies having an expandable platform therebetween, in accordance with embodiments of the present invention. As shown in the Figure, the set 700 may comprise a first ladder assembly 702 and a second ladder assembly 704, essentially forming a ladder system. Each of the ladder assemblies generally comprise plurality of individual ladders, an optional top platform, and a plurality of support platforms, each positioned at a bottom end of each of the individual ladders. In certain embodiments, for example, where a large project in being completed, it may be advantageous to provide at least one expandable platform 770 positioned between the first ladder assembly 702 and the second ladder assembly 704.

As shown in the Figure, the expandable platform 770 may be removably fixed between the first ladder assembly 702 and the second ladder assembly 704 by connection means 772. In accordance with many embodiments of the present invention, the connection means 772 may comprise any type of mechanical fastener suitable for embodiments of the present invention. In one embodiment, the connection means 772 comprises one of a nut and bolt combination, a socket and lock combination, a structural formation on the expandable platform 770 to hook around one of the steps of the ladder assembly, or the like.

Generally, the expandable platform 770 may be positioned at any height along the ladder assembly, from as low as the first step on the ladder assembly (or slightly therebeneath), or as high as the top platform. The expandable platform 770 may optionally be expandable via any number of expansion means. In one embodiment, the expandable platform 770 comprises a telescoping structure such that a portion of the expandable platform 770 may slide out underneath another portion of the expandable platform 770. In another embodiment, the expandable platform may comprise telescoping or connectable rails, having a planar surface connectable thereon. In yet another embodiment, the expandable platform 770 comprises a set size and shape, but may be mechanically fixed to adjacent expandable platforms to obtain the desired length.

Optionally, the expandable platform may be provided with a safety railing 774, supported by one or more railing supports 776. In many embodiments, where an expandable platform 770 is affixed to the ladder assemblies over an unsafe height, the safety railing 774 may be utilized for guided support when walking across the expandable platform 770. In many embodiments, the safety railing 774 may be easily snap, screw, or form fit into a receiving slot on the top surface of the expandable platform 770. In another embodiment, the safety railing 774 may flip or pop up out of the expandable platform 770.

While the foregoing is directed to embodiments of the present invention, other and further embodiments of the invention may be devised without departing from the basic scope thereof. It is also understood that various embodiments described herein may be utilized in combination with any other embodiment described, without departing from the scope contained herein. In addition, embodiments of the present invention may be further scalable, as particular applications may require.

What is claimed is:

1. A multi-faced ladder assembly comprising:

four individual ladders, each ladder comprising a pair of vertical posts and a plurality of steps positioned between the pair of vertical posts, each ladder having a maximum width at the greatest distance between the pair of vertical posts, each step comprising an exterior portion, each vertical post attached to one vertical post of a different ladder;

a substantially square top platform having four sides, each side positioned over and attached to a top portion of one of the four individual ladders, whereby four individuals may climb to the top of the four different ladders simultaneously;

wherein each vertical post is detachably attached to an adjacent vertical post of a different ladder with a ladder securing means, whereby when each vertical post is detachably attached to an adjacent vertical post of a different ladder with the ladder securing means, a distance between each vertical post and the adjacent vertical post of the different ladder is less than the maximum width of each ladder;

wherein the four individual ladders collectively form a substantially contiguous structure substantially along a perimeter of the top platform, whereby the multi-faced ladder assembly comprises a substantially pyramidal square frustum shape, whereby each of the four individual ladders is positioned directly opposite one other ladder of the four individual ladders; and wherein the exterior portion of each step faces outwardly away from a center of the substantially square top platform.

2. The multi-faced ladder assembly of claim 1, wherein the top platform connects to the top of each of the four individual ladders via a locking means.

3. The multi-faced ladder assembly of claim 2, wherein the locking means comprises at least one of a hinge, clasp, clamp, screw, rivet, clip, cable, hook and loop fastener, snap, strap or combinations thereof.

4. The multi-faced ladder assembly of claim 1, wherein the height of the ladder assembly is between about six feet to about fifty feet.

5. The multi-faced ladder assembly of claim 1, further comprising:

a central utility storage unit attached to a bottom surface of the top platform.

6. A multi-faced ladder assembly comprising:

four individual ladders, each ladder comprising a plurality of horizontal steps positioned between a pair of vertical posts, each ladder having a maximum width at the greatest distance between the pair of vertical posts, each horizontal step and each pair of vertical posts comprising an exterior portion, and;

a substantially square top platform having four sides, each side positioned over a top portion of one of the four individual ladders, and connected to the top of each of the four individual ladders via a locking means, wherein the exterior portion of each of the plurality of horizontal steps faces outwardly away from the substantially square top platform, whereby four individuals may climb to the top of the four different ladders simultaneously;

four support platforms, each support platform comprising a trapezoid shape having a narrower end and a wider end, the wider end positioned at a bottom end of each of the four individual ladders, the four support platforms adapted to extend away from the exterior portion of each vertical post in a direction away from a center of the multi-faced ladder assembly; and wherein each vertical post is detachably attached to an adjacent vertical post of a different ladder with a ladder securing means, whereby when each vertical post is detachably attached to an adjacent vertical post of a different ladder with the ladder securing means, a distance between each vertical post and the adjacent vertical post of the different ladder is less than the maximum width of each ladder; and wherein the four ladders collectively form a substantially contiguous structure substantially along a perimeter of the top platform, whereby the multi-faced ladder assembly comprises a substantially pyramidal square frustum.

7. The multi-faced ladder assembly of claim 6, wherein each support platform is connected via a hinge to the bottom of one vertical post of each of the individual ladders.

8. The multi-faced ladder assembly of claim 6, wherein the support platform comprises a non-skid material on a bottom surface thereof.

9. The multi-faced ladder assembly of claim 6, wherein the support platform comprises a top surface comprising a non-stick material.

10. The multi-faced ladder assembly of claim 6, further comprising:

a central utility storage unit attached to a bottom surface of the top platform.

11. A multi-faced ladder assembly comprising:

four individual ladders, each ladder comprising a plurality of horizontal steps positioned between a pair of vertical posts, each ladder having a maximum width at the greatest distance between the pair of vertical posts, each horizontal step and each pair of vertical posts comprising an exterior portion, and;

a substantially square top platform having four sides, each side positioned over a top portion of one of the four individual ladders, and connected to the top of each of the four individual ladders via a locking means, wherein the exterior portion of each of the plurality of horizontal steps faces outwardly away from the single substantially square top platform, whereby four individuals may climb to the top of the four different ladders simultaneously;

four support platforms, each support platform comprising a trapezoid shape having a narrower end and a wider end, the wider end positioned at a bottom end of each of the four individual ladders, the four support platforms adapted to extend away from the exterior portion of each vertical post in a direction away from a center of the multi-faced ladder assembly, each support platform connected to each ladder, respectively, via a hinge, each support platform adapted to move from an open position in contact with a ground surface to a closed position in contact with the ladder, wherein each platform may be locked in the open or the closed position with a locking mechanism;

wherein each vertical post is detachably attached to an adjacent vertical post of a different ladder with a ladder securing means, whereby when each vertical post is detachably attached to an adjacent vertical post of a different ladder with the ladder securing means, a distance between each vertical post and the adjacent vertical post of the different ladder is less than the maximum width of each ladder; and wherein the four ladders collectively form a substantially contiguous structure substantially along a perimeter of the top platform.

* * * * *